US008746937B2

(12) United States Patent
Hong et al.

(10) Patent No.: US 8,746,937 B2
(45) Date of Patent: Jun. 10, 2014

(54) HEAD LAMP ASSEMBLY AND VEHICLE INCLUDING THE SAME

(75) Inventors: Jong-pa Hong, Yongin-si (KR); Hyoung-cheol Cho, Seoul (KR); Hee-seok Park, Suwon-si (KR); Joong-kon Son, Seoul (KR)

(73) Assignee: Samsung Electronics Co., Ltd., Seoul (KR)

( * ) Notice: Subject to any disclaimer, the term of this patent is extended or adjusted under 35 U.S.C. 154(b) by 342 days.

(21) Appl. No.: 13/228,190

(22) Filed: Sep. 8, 2011

(65) Prior Publication Data

US 2012/0092885 A1 Apr. 19, 2012

(30) Foreign Application Priority Data

Oct. 13, 2010 (KR) ..... 10-2010-0099840

(51) Int. Cl.
*F21V 29/00* (2006.01)

(52) U.S. Cl.
USPC ..... 362/373; 362/367; 362/294

(58) Field of Classification Search
USPC ..... 362/294, 373, 367
See application file for complete search history.

(56) References Cited

U.S. PATENT DOCUMENTS

2009/0154189 A1 6/2009 Cho et al.

FOREIGN PATENT DOCUMENTS

| | | |
|---|---|---|
| DE | 10 2005 051248 | 5/2007 |
| DE | 10 2007 043961 | 3/2009 |
| DE | 10 2008 006108 | 7/2009 |
| DE | 10 2009 006093 | 7/2010 |
| JP | 2004-253325 | 9/2004 |
| JP | 2008-100551 | 5/2008 |
| KR | 10-1998-0052782 | 9/1998 |
| KR | 10-0756714 | 9/2007 |
| TW | M 369431 | 11/2009 |
| TW | 2009 49155 | 12/2009 |
| WO | WO 2005/116522 | 12/2005 |

OTHER PUBLICATIONS

Extended European Search Report issued in European Patent Application No. 11180994 dated Nov. 28, 2011.

*Primary Examiner* — Vip Patel
(74) *Attorney, Agent, or Firm* — McDermott Will & Emery LLP

(57) ABSTRACT

A head lamp assembly including a housing; a plurality of head lamp cases installed in the housing, wherein each head lamp case comprises a light emitting diode (LED) light source, and a heat sink for dissipating heat generated from the LED light source; and a plurality of ventilating fans for circulating air in the plurality of head lamp cases and installed in the plurality of head lamp cases, respectively. Accordingly, the ventilating fans installed in the head lamp cases have opposite ventilating directions, and thus air is circulated in the head lamp cases by the ventilating fans to thus improve heat dissipation effects.

20 Claims, 2 Drawing Sheets

HEAD LAMP ASSEMBLY AND VEHICLE INCLUDING THE SAME

CROSS-REFERENCE TO RELATED APPLICATIONS

This application claims the benefit of Korean Patent Application No. 10-2010-0099840, filed on Oct. 13, 2010, in the Korean Intellectual Property Office, the disclosure of which is incorporated herein in its entirety by reference.

BACKGROUND

1. Field

The present disclosure relates to head lamp assemblies and vehicles including the same, and more particularly, to head lamp assemblies including ventilating fans for circulating air and vehicles including the head lamp assemblies.

2. Description of the Related Art

Recently, light sources using light emitting diodes (LEDs) having excellent visibility have been used as head lamps of vehicles. Since the LED has a color temperature of about 5500 K that is similar to sunlight, eyes of a user feel barely tired, and degree of freedom of design for head lamps may be increased.

However, as the performance of a LED is increased, the LED may increasingly emit high-temperature heat, and the heat may reduce the performance of the LED. That is, since a light source using a LED emits high-temperature heat when the light source operates, heat dissipation is required to prevent the heat lamp from being heated due to high-temperature heat generated from the light source using a LED.

Although there is a spatial limit in a head lamp of a vehicle, if a device for dissipating heat is installed in the head lamp, heat dissipation efficiency of the head lamp is increased, and thus the device for dissipating heat is installed in the head lamp.

As a method of dissipating heat generated from a head lamp of a vehicle, a cooling fan, a pin heatpipe, and the like may be used, heat may be dissipated from the head lamp of the vehicle by using natural wind during a drive, or heat may be compulsorily circulated by a ventilating fan.

In the method of dissipating heat by using a cooling fan and a pin heatpipe, heat generated from the light source using a LED is dissipated out of a head lamp through a cold part of the head lamp by using a heat dissipation module including a heat sink, a pin, a heatpipe and a cooling fan. However, in this case, since the heatpipe through which the heat moves occupies a space, use of a space of the heat lamp may be reduced.

In the method of using natural wind during a drive of a vehicle, an air path is formed so that natural wind (air) may be easily introduced to the head lamp of the vehicle. However, during a stop of the vehicle, since natural wind is not formed, there is likely to cause a problem with heat dissipation.

In the method of compulsorily circulating heat, if an appropriate path is not provided in the head lamp, heat dissipation effects may be reduced, and thus the path needs to be formed in order to increase heat dissipation effects.

SUMMARY

Provided are head lamp assemblies in which a fan for circulating air in a sealed head lamp is disposed, a hole is formed in a head lamp case, and a guide is formed so that an air flow generated by the fan may pass through a heat sink to thus have improved heat dissipation performance, and vehicles including the head lamp assemblies.

Additional aspects will be set forth in part in the description which follows and, in part, will be apparent from the description, or may be learned by practice of the presented embodiments.

According to an aspect of the present invention, a head lamp assembly includes a housing; a plurality of head lamp cases installed in the housing, wherein each head lamp case includes a light emitting diode (LED) light source, and a heat sink for dissipating heat generated from the LED light source; and a plurality of ventilating fans for circulating air in the plurality of head lamp cases and installed in the plurality of head lamp cases, respectively.

According to another aspect of the present invention, a head lamp assembly includes a housing; a transparent window for transmitting light and installed in one side of the housing; a plurality of head lamp cases installed in the housing, wherein each head lamp case includes a light emitting diode (LED) light source, and a heat sink for dissipating heat generated from the LED light source; and a plurality of ventilating fans for circulating air in the plurality of head lamp cases and installed so as to be connected to an air inlet installed in one side of the head lamp case, wherein an air outlet is formed in one side of the head lamp case so that air is emitted out of the head lamp case by the ventilating fan.

According to another aspect of the present invention, a head lamp assembly including a housing; a transparent window for transmitting light and installed in one side of the housing; a plurality of head lamp cases installed in the housing, wherein each head lamp case includes a light emitting diode (LED) light source, and a heat sink for dissipating heat generated from the LED light source; a plurality of ventilating fans for circulating air in the plurality of head lamp cases and installed so as to be connected to an air inlet installed in one side of the head lamp case; and a guide portion for guiding air towards the heat sink.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
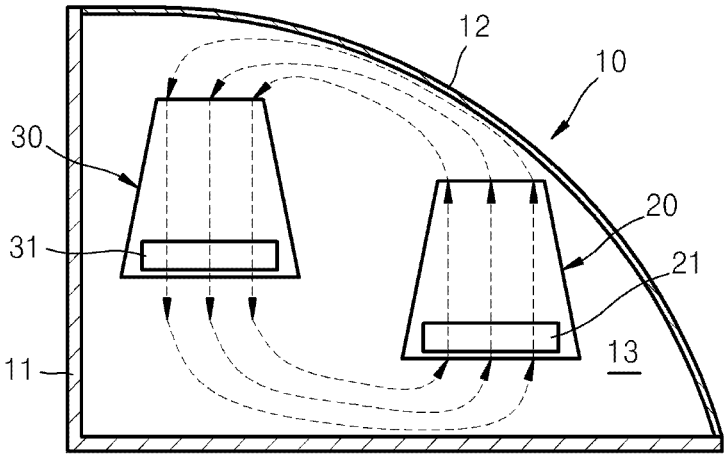
FIG. 1 is a diagram illustrating an air flow by a plurality of ventilating fans of a head lamp assembly of a vehicle, according to an embodiment of the present invention.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
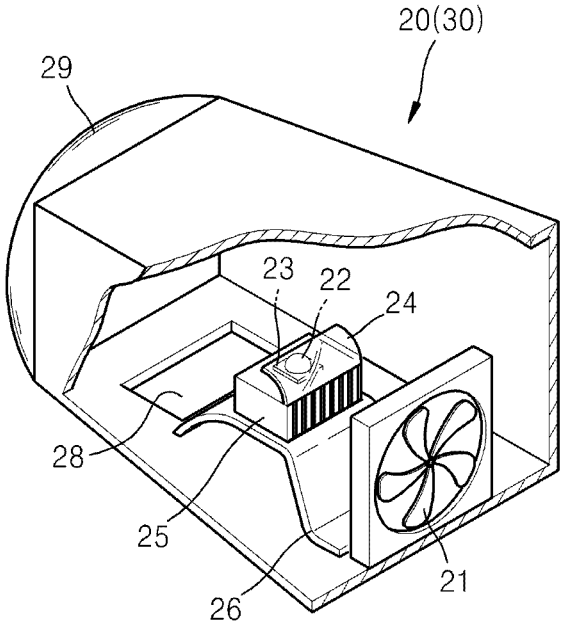
FIG. 2 is a perspective view of a head lamp case, according to an embodiment of the present invention.
Figure 3:
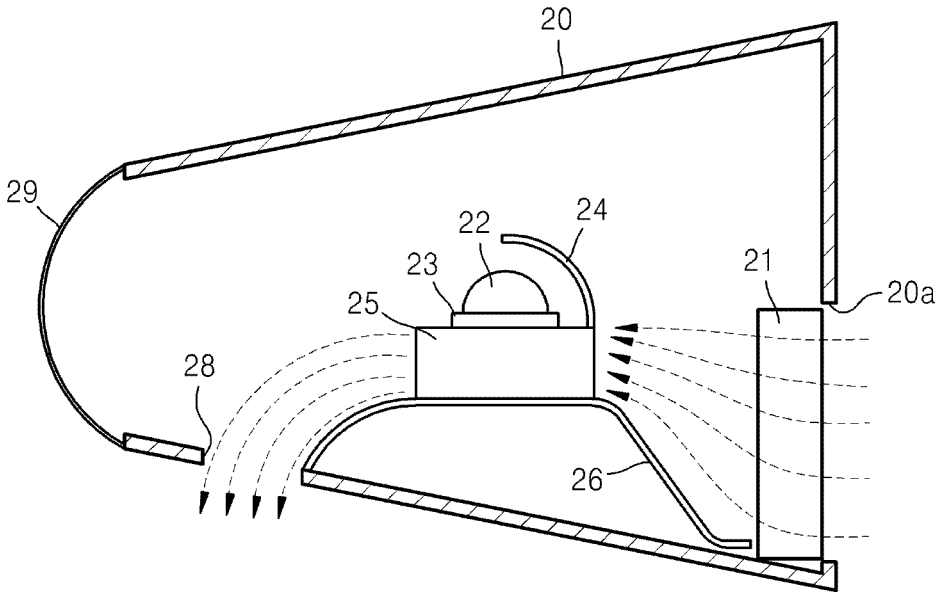
FIG. 3 is a lateral cross-sectional view of an air flow in the head lamp case of FIG. 2, according to an embodiment of the present invention.

FIG. 1 is a diagram illustrating an air flow by a plurality of ventilating fans 21 and 31 of a head lamp assembly 10 of a vehicle, according to an embodiment of the present invention. FIG. 2 is a perspective view of a head lamp case, according to an embodiment of the present invention. FIG. 3 is a lateral cross-sectional view of an air flow in the head lamp case of FIG. 2, according to an embodiment of the present invention.

Referring to FIG. 1, head lamp assemblies are installed on right and left sides of an engine room (not shown) installed in a front portion of the vehicle, and emit light forwards. The head lamp assembly 10 of FIG. 1 is installed on the right side of the engine room. However, a head lamp assembly (not shown) for the left side of the engine room is similar to the head lamp assembly 10.

The head lamp assembly 10 includes a housing 11, and an inner space 13 in which a transparent window 12 for transmitting light therethrough and installed in one side of the housing 11, wherein the inner space portion 13 is sealed. The housing 11 contacts the engine room, and the transparent window 12 is installed so as to face forwards. Two head lamp cases 20 and 30 are installed parallel to each other in the inner space portion 13. Herein, a reference number 20 denotes a first head lamp case, and a reference number 30 denotes a second head lamp case.

A first ventilating fan 21 is installed in the first head lamp case 20, and a second ventilating fan 31 is installed in the second head lamp case 30. The first ventilating fan 21 and the second ventilating fan 31 are installed so as to have opposite ventilating directions. Thus, the first ventilating fan 21 may cause an air to flow in a backwards direction from a front portion of the first head lamp case 20. The second ventilating fan 31 may cause the air from the first ventilating fan 21 to flow in a forwards direction from a rear portion of the second head lamp case 30. The air flowing in a forwards direction of the second head lamp case 30 may flow in the first head lamp case 20 by the first ventilating fan 21 again. Air may be circulated in the first head lamp case 20 and the second head lamp case 30 by the first ventilating fan 21 and the second ventilating fan 31.

Likewise, since the air in the head lamp assembly 10 is circulated through both the first head lamp case 20 and the second head lamp case 30, heat in the first head lamp case 20 and the second head lamp case 30 is circulated to thus improve heat dissipation.

A temperature of the inner space 13 of the head lamp assembly 10 may be 200 degrees or more, but a temperature of an outside of the transparent window 12 is a normal temperature of about −10 to about 40. Thus, although the head lamp assembly 10 is sealed, heat may be naturally dissipated due to conduction using the transparent window 12.

Referring to FIGS. 2 and 3, the first head lamp case 20 includes an air inlet 20*a* formed on one side thereof and a projection lens 29 for emitting light forwards and formed on the other side facing the air inlet 20*a*. The first head lamp case 20 and the second head lamp case 30 have the same structure, but have opposite ventilation directions. For convenience of description, examples of the first head lamp case 20 will be descried below.

The first ventilating fan 21 is installed in the first head lamp case 20 so as to contact the air inlet 20*a*. Thus, when the first ventilating fan 21 operates, air is introduced to the first head lamp case 20 through the air inlet 20*a*.

Between the first ventilating fan 21 and the projection lens 29, a light emitting diode (LED) light source 22, a LED light source fixing block 23 for supporting and fixing the LED light source 22, a reflector 24 for reflecting light emitted from the LED light source 22 towards the projection lens 29, and a heat sink 25 for dissipating heat generated from the LED light source 22 and installed in a lower portion of the LED light source fixing block 23. The heat sink 25 increases an area for heat dissipation, and is not limited to FIG. 2. Modified examples having the same function may be used.

An air outlet 28 is formed in a lower surface 20*b* of the first head lamp case 20. Air introduced through the air inlet 20*a* by the first ventilating fan 21 may be emitted out of the second head lamp case 30 through an air outlet 28. A position at which the air outlet 28 is formed is not limited to FIGS. 2 and 3. Alternatively, the air outlet 28 may be installed on one surface of the first head lamp case 20.

A guide portion 26 is spaced apart from a bottom portion of the heat sink 25 by a predetermined distance. The guide portion 26 is bent from a bottom surface of the first ventilating fan 21 towards the heat sink 25 so as to dispose parallel to the bottom surface of the heat sink 25. The guide portion 26 is bent in a downwards direction to the air outlet 28. Thus, air introduced from a portion below the first ventilating fan 21 flows towards the heat sink 25 and air passing through the heat sink 25 flows towards the air outlet 28.

The structure and shape of the guide portion 26 are not limited to FIGS. 2 and 3. That is, any structure and shape of the guide portion 26 may be used as long as air introduced from may flow towards the heat sink 25 and air passing through the heat sink 25 may flow towards the air outlet 28.

As shown in FIG. 3, when the first ventilating fan 21 operates, air introduced through the air inlet 20*a* may pass through the heat sink 25, and air introduced in a downwards direction of the first ventilating fan 21 may flow towards the heat sink 25 due to the guide portion 26 so as to pass through the heat sink 25. Air passing through the heat sink 25 flows towards the air outlet 28 due to the guide portion 26 so as to be emitted from a lower portion of the first head lamp case 20 through the air outlet 28.

Referring to FIG. 1, air emitted from the first head lamp case 20 is introduced to the second head lamp case 30 through an air outlet (not shown) of the second head lamp case 30 by the second ventilating fan 31 and flows towards the heat sink 25 due to the guide portion 26. Air passing through the heat sink 25 is emitted out of the second head lamp case 30 through the second ventilating fan 31. Air emitted out of the second head lamp case 30 is introduced to the first head lamp case 20 by the first ventilating fan 21 to thus be circulated in the first head lamp case 20 and the second head lamp case 30.

So far, a case where a head lamp assembly is used in a vehicle has been described. However, embodiments of the present invention are not limited thereto. The head lamp assembly may be used in a transportation using a head lamp assembly, such as a motorcycle, a train, a truck, a bus, heavy equipment, and the like.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A head lamp assembly, comprising:

a housing; and a plurality of head lamp cases disposed in the housing including a first head lamp case and a second head lamp case, wherein each of the first and second head lamp cases includes:

a light emitting diode (LED) light source, a heat sink for dissipating heat generated from the LED light source, and a ventilating fan configured to circulate air into and out of each of the first and second head lamp cases, wherein:

the ventilating fans of the first and second lamp cases are disposed in respective rear portions of the first and second lamp cases and are parallel with each other, the ventilating fan of the first head lamp case is configured to cause the air to flow in from a front portion of the first head lamp case and flow out to the rear portion of the second head lamp case, and the ventilating fan of the second head lamp case is configured to cause the air to flow in from the rear portion of the second lamp case and flow out to the front portion of the first head lamp case.

2. The head lamp assembly 1, wherein the ventilating fans of the plurality of head lamp cases have opposite ventilating directions.

3. The head lamp assembly 1, wherein the ventilating fan of each of the first and second head lamp cases is connected to an air inlet defined in one side of the head lamp case.

4. The head lamp assembly 1, wherein an air outlet is defined in one side of each of the first and second head lamp cases such that air is emitted out of each of the first and second head lamp cases by the ventilating fan of each of the first and second head lamp cases.

5. The head lamp assembly 1, further comprising a guide portion for guiding air towards the heat sink of each of the first and second head lamp cases.

6. The head lamp assembly 1, further comprising a transparent window for transmitting light and disposed in one side of the housing.

7. The head lamp assembly 6, wherein the head lamp assembly is sealed by the housing and the transparent window.

8. A head lamp assembly, comprising:

a housing; and a transparent window for transmitting light and disposed in one side of the housing;

a plurality of head lamp cases disposed in the housing, wherein each of the plurality of head lamp cases includes:

a light emitting diode (LED) light source, a heat sink for dissipating heat generated from the LED light source, and a ventilating fan configured to circulate air in each of the plurality of head lamp cases and connected to an air inlet defined in a side surface of each of the plurality of head lamp cases, such that the ventilating fan emits air out of each of the plurality of head lamp cases to an air outlet defined in a lower surface of each of the plurality of head lamp cases.

9. The head lamp assembly of claim 8, wherein the ventilating fans of the plurality of head lamp case have opposite ventilating directions.

10. The head lamp assembly of claim 8, further comprising a guide portion for guiding air towards the heat sink of each of the plurality of head lamp cases.

11. The head lamp assembly of claim 8, wherein the head lamp assembly is sealed by the housing and the transparent window.

12. A head lamp assembly, comprising:

a housing;

a transparent window for transmitting light and disposed in one side of the housing; and a plurality of head lamp cases disposed in the housing, wherein each of the plurality of head lamp cases includes:

a light emitting diode (LED) light source, a heat sink for dissipating heat generated from the LED light source disposed on a top surface of the heat sink, a ventilating fan configured to circulate air in each of the plurality of head lamp cases and connected to an air inlet defined in one side of each of the plurality of head lamp cases; and to an air outlet defined in another side of each of the plurality of head lamp cases, and a guide portion for guiding air towards the heat sink, the guide portion extending parallel with a bottom surface of the heat sink and being bent down toward the air outlet.

13. The head lamp assembly of claim 12, wherein the plurality of ventilating fans of the plurality of head lamp cases have opposite ventilating directions.

14. The head lamp assembly of claim 12, wherein an air outlet is defined in one side of each of the plurality of head lamp cases such that air is emitted out of each of the plurality of head lamp cases by the ventilating fan of each of the plurality of head lamp cases.

15. The head lamp assembly of claim 12, wherein the head lamp assembly is sealed by the housing and the transparent window.

16. A vehicle comprising the head lamp assembly of any one of claims 1 through 15.

17. A head lamp assembly, comprising:

a housing; and a plurality of head lamp cases disposed in the housing, wherein each of the plurality of head lamp cases comprises:

a case;

a light emitting diode (LED) light source disposed within the case;

a heat sink disposed within the case for dissipating heat generated from the LED light source;

an air inlet defined in one side of the case;

a ventilating fan disposed in the case and connected to the air inlet;

an air outlet defined in one side of the case; and a guide portion configured to guide air introduced through the air inlet by the ventilating fan towards the heat sink and allow the air to pass through the heat sink towards the air outlet to emit the air out of the case.

18. The head lamp assembly of claim 17, further comprising a transparent window for transmitting light and disposed in one side of the housing.

19. The head lamp assembly of claim 18, wherein the head lamp assembly is sealed by the housing and the transparent window.

20. The head lamp assembly of claim 17, wherein the ventilating fans of the plurality of head lamp cases have opposite ventilating directions.

* * * * *